US011094275B2

(12) United States Patent
Lee et al.

(10) Patent No.: US 11,094,275 B2
(45) Date of Patent: Aug. 17, 2021

(54) AFTERIMAGE COMPENSATOR AND DISPLAY DEVICE HAVING THE SAME

(71) Applicant: Samsung Display Co., Ltd., Yongin-si (KR)

(72) Inventors: Jae Hoon Lee, Yongin-si (KR); Seung Ho Park, Yongin-si (KR); Hee Sook Park, Yongin-si (KR); Kyoung Ho Lim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/673,768

(22) Filed: Nov. 4, 2019

(65) Prior Publication Data

US 2020/0226992 A1 Jul. 16, 2020

(30) Foreign Application Priority Data

Jan. 14, 2019 (KR) ..... 10-2019-0004841

(51) Int. Cl.
*G09G 5/10* (2006.01)
*G09G 3/36* (2006.01)

(52) U.S. Cl.
CPC ... *G09G 3/3662* (2013.01); *G09G 2320/0257* (2013.01); *G09G 2320/045* (2013.01)

(58) Field of Classification Search
USPC ..... 345/690, 691, 212, 77, 207, 204, 694, 345/156, 87; 348/234, 649, 353; 382/167, 100, 103
See application file for complete search history.

(56) References Cited

U.S. PATENT DOCUMENTS 10,068,537 B2 9/2018 Lee et al.
2005/0146492 A1* 7/2005 Baba ..... G09G 3/3607 345/87
2006/0238502 A1* 10/2006 Kanamori ..... G06F 3/011 345/156
2008/0297451 A1* 12/2008 Marcu ..... G09G 5/12 345/77
2010/0080458 A1* 4/2010 Yamada ..... H04N 9/646 382/167
2011/0134150 A1* 6/2011 Imamura ..... G06F 3/1446 345/690
2011/0279426 A1* 11/2011 Imamura ..... G09G 3/30 345/207
2012/0039507 A1* 2/2012 Ikenoue ..... G06K 9/00362 382/103

(Continued)

FOREIGN PATENT DOCUMENTS

KR 10-2015-0102134 A 9/2015
KR 10-2016-0089932 A 7/2016

(Continued)

*Primary Examiner* — Thuy N Pardo
(74) *Attorney, Agent, or Firm* — Lewis Roca Rothgerber Christie LLP

(57) ABSTRACT

An afterimage compensator and a display device having the same are disclosed, and the afterimage compensator includes an image analyzer configured to determine an amount of image variation based on a change of image data, and an image shifter configured to adjust a shift interval, which is an interval between time points at which an image is shifted, according to the amount of image variation.

17 Claims, 6 Drawing Sheets

(56) References Cited

U.S. PATENT DOCUMENTS

| | | | | |
|---|---|---|---|---|
| 2012/0154683 | A1* | 6/2012 | Yamashita | G09G 3/3233 348/649 |
| 2014/0016817 | A1* | 1/2014 | Nakagata | G06T 1/005 382/100 |
| 2014/0028734 | A1* | 1/2014 | Fujishiro | G09G 3/2003 345/690 |
| 2014/0320552 | A1* | 10/2014 | Seo | G09G 3/3648 345/690 |
| 2015/0154910 | A1* | 6/2015 | Okuno | G09G 3/3283 345/212 |
| 2015/0215517 | A1* | 7/2015 | Kusaka | H04N 9/04557 348/353 |
| 2015/0379695 | A1* | 12/2015 | Naruse | H04N 1/6005 348/234 |
| 2016/0210900 | A1 | 7/2016 | Kim | |
| 2016/0329019 | A1* | 11/2016 | An | G09G 3/20 |
| 2017/0061892 | A1* | 3/2017 | Jung | G09G 3/3291 |
| 2018/0012563 | A1 | 1/2018 | Lee et al. | |
| 2018/0025468 | A1 | 1/2018 | Kim et al. | |
| 2018/0068603 | A1* | 3/2018 | Noh | G09G 3/2092 |
| 2018/0184013 | A1* | 6/2018 | Hamano | H04N 5/265 |
| 2018/0268752 | A1* | 9/2018 | Zhuang | G09G 3/3233 |
| 2020/0258451 | A1* | 8/2020 | Takahara | G09G 3/3275 |
| 2020/0351481 | A1* | 11/2020 | Kokido | B60R 1/00 |

FOREIGN PATENT DOCUMENTS

| | | | |
|---|---|---|---|
| KR | 10-2018-0006584 | A | 1/2018 |
| KR | 10-2018-0011581 | A | 2/2018 |

* cited by examiner

AFTERIMAGE COMPENSATOR AND DISPLAY DEVICE HAVING THE SAME

CROSS-REFERENCE TO RELATED APPLICATION

The application claims priority to, and the benefit of, Korean Patent Application No. 10-2019-0004841, filed Jan. 14, 2019, which is hereby incorporated by reference for all purposes as if fully set forth herein.

BACKGROUND

1. Field

Embodiments disclosed herein relate to a display device having an afterimage compensator.

2. Discussion

In a display device, such as an organic light emitting display device, an inorganic light emitting display device, a liquid crystal display (LCD) device, a plasma display device, or the like, as driving time elapses, pixels deteriorate, and an afterimage may occur. For example, a fixed image, such as a logo or a subtitle displayed at a high luminance, may be continuously or frequently displayed for a long time in a specific area of a display screen. As a result, deterioration of a specific pixel may be accelerated and an afterimage may be generated.

Recently, to solve such a problem, a technique of moving and displaying an image on a display panel at a given interval has been used.

SUMMARY

An aspect of embodiments of the present disclosure provides an afterimage compensator that adjusts a shift interval of an image according to an amount of image variation.

Another aspect of embodiments of the present disclosure is provides a display device having the afterimage compensator.

The present disclosure is not limited to the above-mentioned aspects. Aspects of embodiments of the present disclosure may be variously extended without departing from the spirit and scope of the invention.

According to one embodiment, an afterimage compensator may include an image analyzer configured to determine an amount of image variation based on a change of image data, and an image shifter configured to adjust a shift interval, which is an interval between time points at which an image is shifted, according to the amount of image variation.

The image shifter may be configured to decrease the shift interval as the amount of image variation increases.

The image shifter may be configured to change luminance of a shifted image to a target luminance in a stepwise manner during a smoothing period when the image is shifted.

The image shifter may be configured to decrease the smoothing period as the amount of image variation increases.

The image shifter may be configured to decrease the smoothing period as the shift interval is decreased.

The image analyzer may be configured to determine the amount of image variation at a time of shifting the image.

The image shifter may include a shift interval determiner configured to decrease the shift interval as the amount of image variation increases, and a smoothing period determiner configured to decrease a smoothing period for which luminance of a shifted image is changed to a target luminance in a stepwise manner as the amount of image variation increases.

The shift interval determiner and the smoothing period determiner may be configured to determine the shift interval and the smoothing period using a lookup table in which a plurality of shift intervals and a plurality of smoothing periods respectively corresponding to a plurality of ranges of the amount of image variation.

The image analyzer may be configured to determine the amount of image variation from a change of grayscale between adjacent frames.

The image analyzer may include a grayscale sum calculator configured to calculate grayscale sums of a plurality of pixel blocks, and a variation determiner configured to calculate differences between the grayscale sums of the pixel blocks between adjacent frames, and to determine the amount of image variation using an average of the differences of the grayscale sums.

The image analyzer may be configured to determine the amount of image variation from a ratio of a number of pixels in which the image data is changed to a total number of the pixels.

According to another embodiment, a display device may include a display panel including a plurality of pixels, an afterimage compensator configured to correct an image data so that an image displayed on the display panel is shifted, and configured to adjust a shift interval of the image based on an amount of image variation, and a data driver configured to provide a data signal corresponding to a corrected image data to the display panel.

The afterimage compensator may include an image analyzer configured to determine the amount of image variation based on a change of the image data between frames, and an image shifter configured to adjust a shift interval, which is an interval between time points at which an image is shifted, according to the amount of image variation, and configured to adjust a smoothing period for which luminance of a shifted image is changed to a target luminance in a stepwise manner.

The image shifter may be configured to decrease the shift interval as the amount of image variation increases.

The image shifter may be configured to decrease the smoothing period as the shift interval decreases.

The image shifter may be configured to decrease the smoothing period as the amount of image variation increases.

The image analyzer may be configured to determine the amount of image variation at a time of shifting the image.

BRIEF DESCRIPTION OF THE DRAWINGS

The accompanying drawings, which are included to provide a further understanding of embodiments of the present disclosure, and which are incorporated in and constitute a part of this specification, illustrate embodiments of the present disclosure, and, together with the description, serve to explain aspects thereof.

DETAILED DESCRIPTION

Figure 1:
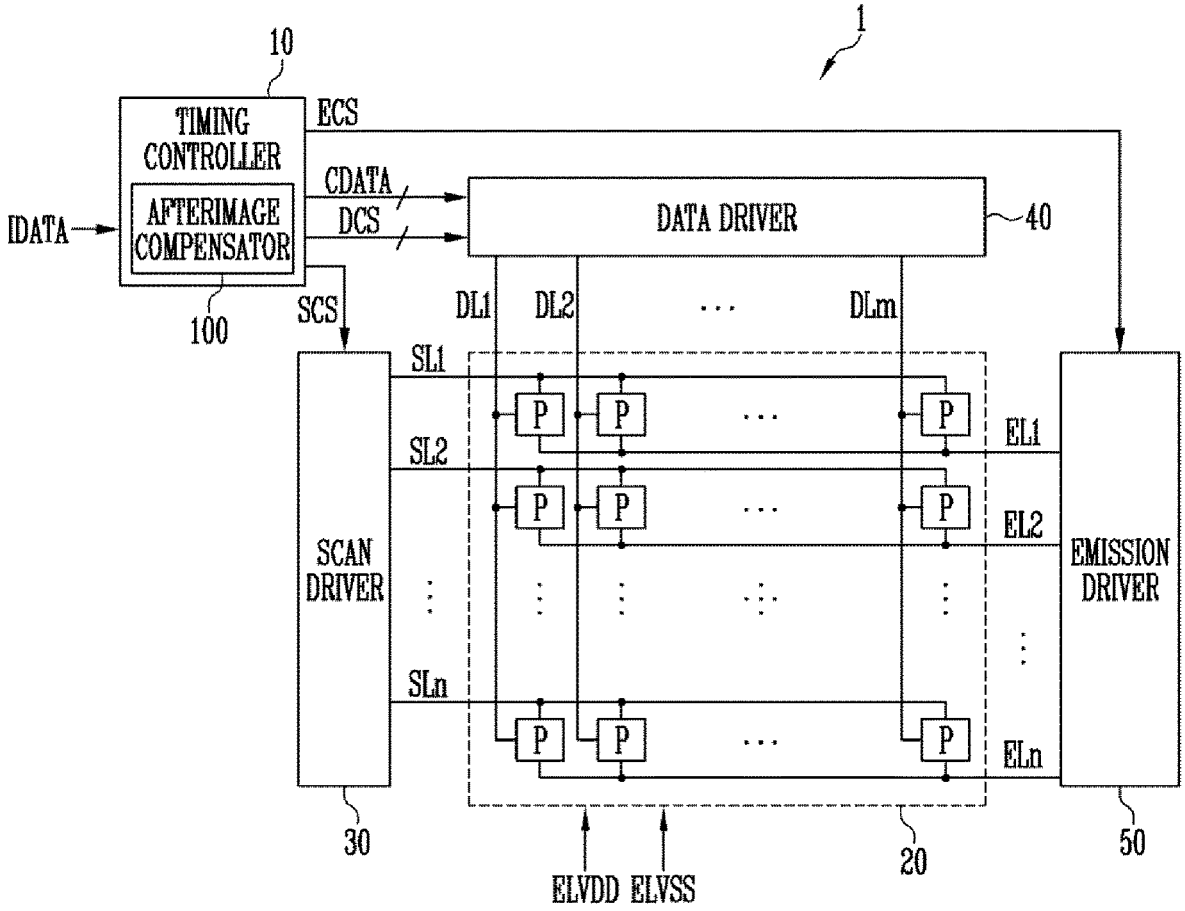
FIG. 1 is a block diagram showing a display device according to an embodiment of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram showing a display device according to an embodiment of the present disclosure.

Referring to FIG. 1, a display device 1 may include a timing controller 10, a display panel 20, a scan driver 30, a data driver 40, an emission driver 50, and an afterimage compensator 100.

In an embodiment, a configuration of at least a part of the afterimage compensator 100 may be included in the timing controller 10 and/or the data driver 40.

In another embodiment, the afterimage compensator 100 may be composed of hardware and/or software.

For example, a function of at least one of the data driver 40, the timing controller 10, and the afterimage compensator 100 may be included in one driver chip.

In an embodiment, the display device 1 may be an organic light emitting display device including a plurality of organic light emitting devices. In another embodiment, the display device 1 may be a display device including inorganic light emitting devices, a liquid crystal display device, a plasma display device, a quantum dot display device, or the like.

The display panel 20 may include a plurality of pixels P. The display panel 20 may be connected to the scan driver 30 through a plurality of scan lines SL1 to SLn, may be connected to the emission driver 50 through a plurality of emission control lines EL1 to ELn, and may be connected to the data driver 40 through a plurality of data lines DL1 to DLm. The display panel 20 may include m (m is a positive integer) pixel columns connected to the data lines DL1 to DLm, and n (n is a positive integer) pixel rows connected to the scan lines SL1 to SLn and to the emission control lines EL1 to ELn, respectively. The display panel 20 may display a shifted image based on an image data IDATA (e.g., input image data that is received from outside), or based on a corrected image data CDATA, which may be generated by the afterimage compensator 100 after receiving the image data IDATA.

The display panel 20 may display a main image, which includes substantial image information, and may also display a fixed image. The fixed image may be displayed at a high luminance (high grayscale), and may be displayed for a given amount of time or longer. For example, the fixed image may include a broadcasting company logo, a caption, a date, a time, and the like.

As an example, when the display panel 20 displays a navigation image or a GPS image, the fixed image may be a user's current position image that is displayed at a center of the display panel 20.

The scan driver 30 may provide a scan signal to the display panel 20 through the plurality of scan lines SL1 to SLn. In an embodiment, each of the scan lines SL1 to SLn may be respectively connected to the pixels P located in each pixel row of the display panel 20.

The data driver 40 may provide a data signal to the display panel 20 through the plurality of data lines DL1 to DLm according to the scan signal. In an embodiment, the data driver 40 may generate a data signal corresponding to the corrected image data CDATA, and may provide the data signal to the display panel 20. In an embodiment, each of the data lines DL1 to DLm may be respectively connected to the pixels P located in each pixel column of the display panel 20.

The emission driver 50 may provide an emission control signal to the display panel 20 through the plurality of emission control lines EL1 to ELn. In an embodiment, each of the emission control lines EL1 to ELn may be respectively connected to the pixels P located in each pixel row of the display panel 20.

The timing controller 10 may generate a plurality of control signals SCS, DCS, and ECS, and may supply the control signals SCS, DCS, and ECS to the scan driver 30, the data driver 40, and the emission driver 50, respectively, to control the scan driver 30, the data driver 40, and the emission driver 50. The timing controller 10 may receive an input control signal and the image data IDATA from an image source, such as an external graphic device. The input control signal may include a main clock signal, a vertical synchronization signal, a horizontal synchronization signal, and/or a data enable signal.

The timing controller 10 may generate an image data conforming to an operating condition of the display panel 20 based on the image data IDATA, and may provide the image data to the data driver 40. In addition, the timing controller 10 may generate a first control signal SCS for controlling a driving timing of the scan driver 30, a second control signal DCS for controlling a driving timing of the data driver 40, and a third control signal ECS for controlling a driving timing of the emission driver 50, and may provide the first control signal SCS, the second control signal DCS, and the third control signal ECS to the scan driver 30, the data driver 40, and the emission driver 50.

In an embodiment, the afterimage compensator 100 may be included in the timing controller 10. In another embodiment, the afterimage compensator 100 may be separate from, and connected with, the timing controller 10.

An image may be shifted and displayed on the display panel 20 to reduce or prevent an afterimage due to a fixed image, such as a logo, being displayed by the same pixel P for a relatively long time.

The afterimage compensator 100 may shift the image data IDATA and the image (e.g., at a predetermined interval). The afterimage compensator 100 may use various image-shifting methods to increase or maximize a shift effect of the fixed image, and to reduce or minimize deterioration of the fixed image.

In an embodiment, the afterimage compensator 100 may include an image analyzer that determines an amount of image variation based on a change in the image data IDATA of a frame, and may include an image shifter for adjusting a shift interval, which is an interval between time points at which an image is shifted according to the amount of image variation. The afterimage compensator 100 may adjust a smoothing period in which luminance of a shifted image is changed stepwise to a target luminance according to the amount of image variation and/or the shift interval.

Figure 2:
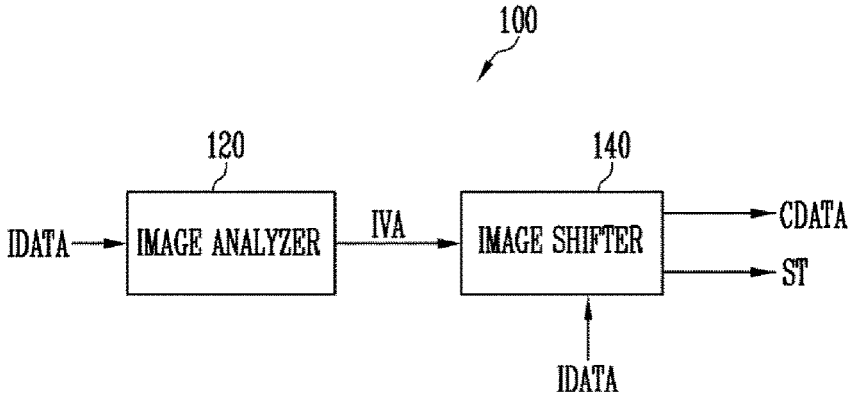
FIG. 2 is a block diagram showing an afterimage compensator according to an embodiment of the present disclosure.
Figure 3A:
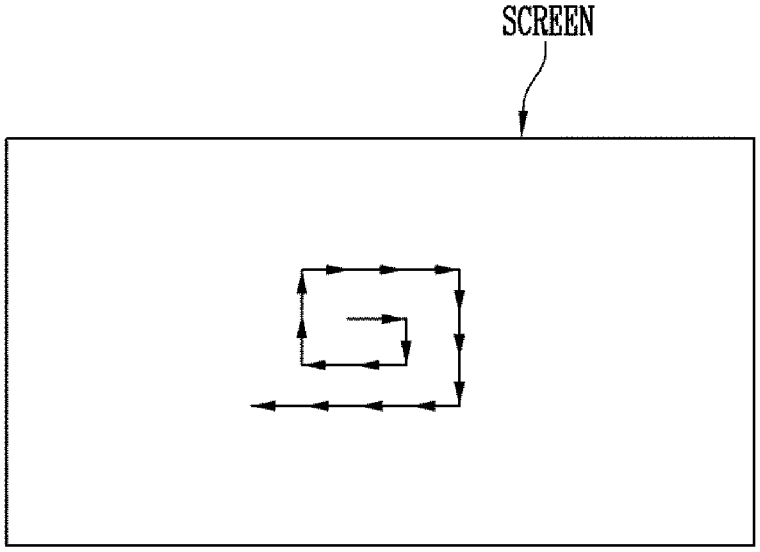
FIGS. 3A and 3B are diagrams showing examples of an image shift by the afterimage compensator of FIG. 2.
Figure 3B:
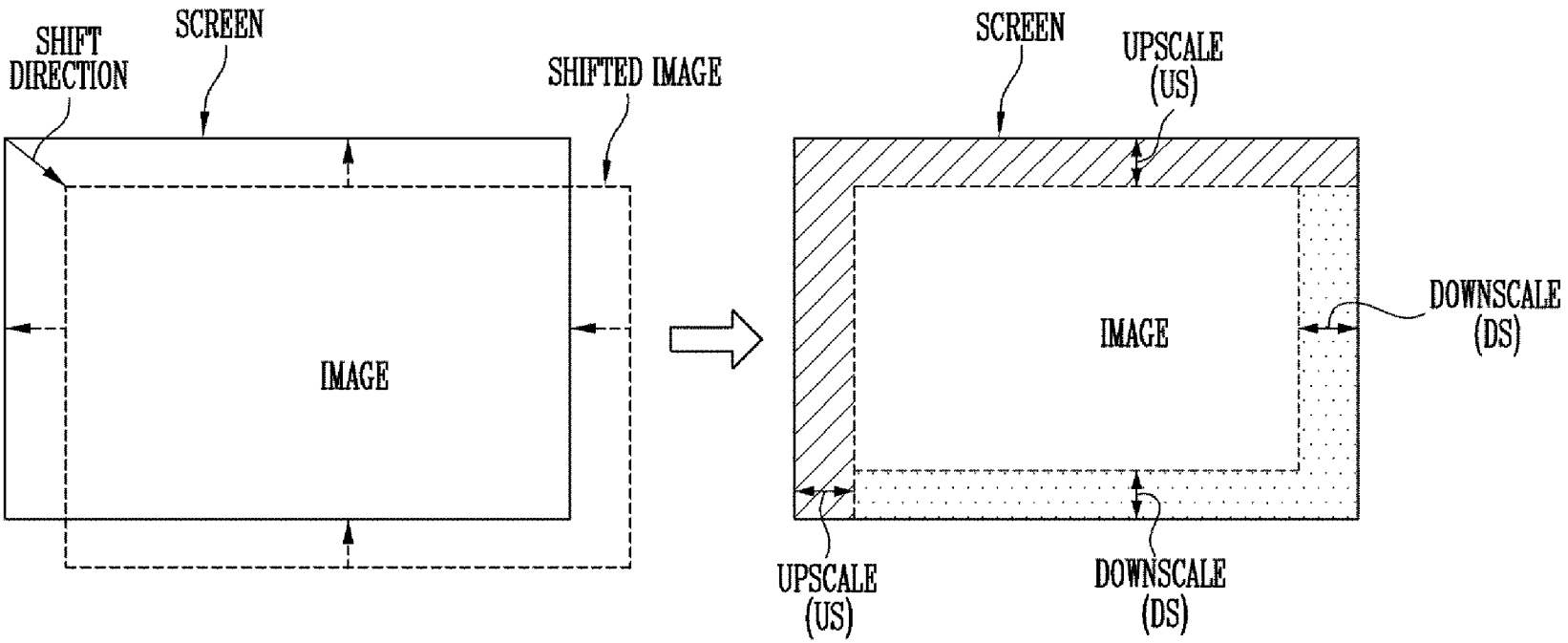

FIG. 2 is a block diagram showing an afterimage compensator according to an embodiment of the present disclosure. FIGS. 3A and 3B are diagrams showing examples of an image shift by the afterimage compensator of FIG. 2.

Referring to FIGS. 1, 2, 3A, and 3B, the afterimage compensator 100 may include an image analyzer 120 and an image shifter 140.

The image analyzer 120 may determine the amount of image variation IVA based on a change of the image data IDATA (or input image data) of the frame. In an embodiment, the image analyzer 120 may determine the amount of image variation IVA from a change of grayscale between adjacent frames. For example, the image analyzer 120 may determine whether the current image is a still image or a moving image by comparing the image data IDATA of a previous frame with the image data IDATA of a current frame. For example, the amount of image variation of an image representing a sports broadcast may be analyzed to be greater than that of an image representing a work document.

The image analyzer 120 may determine the amount of image variation IVA from a ratio of a number of the pixels P whose image data IDATA has changed to a number of all of the pixels P. However, a method in which the image analyzer 120 determines the amount of image variation IVA is not limited thereto. For example, the image analyzer 120 may analyze the amount of image variation IVA based on a change of the image data IDATA accumulated for a given time interval.

The image analyzer 120 may set a plurality of ranges of amounts of image variation for classifying a degree of image variation, and may select one range including the amount of image variation IVA from among the plurality of ranges according to a degree of change related to the current image.

In some embodiments, the image analyzer 120 may determine the amount of image variation IVA occurring within a predetermined interval or period. For example, the image analyzer 120 may determine the amount of image variation IVA at the time of image shift.

In another embodiment, the image analyzer 120 may determine the amount of image variation IVA at a uniform time interval. A time point at which the amount of image variation IVA is analyzed is not limited thereto.

The image analyzer 120 may provide an image shifter 140 with data including the amount of image variation IVA.

According to some embodiments, the image shifter 140 may perform a shift operation on the image data IDATA. For example, the image shifter 140 may perform image shifting at predetermined time intervals.

The image shifter 140 may adjust a shift interval ST, which is an interval between time points at which an image is shifted according to the amount of image variation IVA. The image shifter 140 may shorten the shift interval ST as the amount of image variation IVA increases. In addition, the image shifter 140 may adjust a length of a smoothing period, in which luminance of a shifted image is changed stepwise to a target luminance based on the amount of image variation IVA and/or the shift interval ST. For example, the image shifter 140 may adjust the smoothing period to be shorter as the amount of image variation IVA increases.

As shown in FIG. 3A, according to an embodiment, the afterimage compensator 100 may shift the image (and the image data IDATA) (e.g., according to a predetermined period or a predetermined shift scenario). For example, the afterimage compensator 100 and the image shifter 140 included therein may rearrange the image data IDATA so that the image data IDATA and the corresponding image are shifted (e.g., in a predetermined shift direction). The corrected image data CDATA may be provided to the timing controller 10 or to the data driver 40. A correction method of the image data IDATA for image shift may be implemented by various image shift techniques.

In FIG. 3A, the present example assumes that a size of one arrow indicates one pixel. In FIG. 3B, an image may be shifted in any one direction of left, right, down, and up at every shift interval. For example, as time elapses, the image may shift in a clockwise spiral. The shifted direction and the shifted amount of a shifted image, as well as the shifted portion, are not limited to the present example. For example, an image shift may be performed only in a part of the entire image, and the shifted direction, the shifted amount, and the like, may be freely changed to reduce or minimize deterioration and afterimage.

As shown in FIG. 3B, in an embodiment, the afterimage compensator 100 and the image shifter 140 included therein may correct an image by shifting an entire image, and by scaling (upscale or downscale) a part of the shifted image.

When the entire image is shifted, a black screen on which no image is displayed may be displayed on a part of the display panel 20 (or on a part of a screen), and a portion of an image may be cut off on another part of the display panel 20.

The image shifter 140 may downscale an image of a portion out of the screen, and may upscale an image of a black portion. Accordingly, the portion where the image is cut off, and the portion where the black image is displayed due to loss of the image, may be removed by scaling and shifting.

The image shifter 140 may determine an upscaling area, or upscaling amount, US and a downscaling area, or downscaling amount, DS of the screen (or of the image data IDATA), which may correspond to a predetermined shift path, to shift the image. In the present embodiment, the upscaling area US and the downscaling area DS may be determined within a predetermined area of the screen. For example, the upscaling area US and the downscaling area DS may be predetermined pixel rows and/or pixel columns that are continuous from an edge of the display panel 20 (e.g., from an outermost pixel row and/or from an outermost pixel column), and may correspond to image data. The image data corresponding to the upscaling area US may be upscaled, and the image data corresponding to the downscaling area DS may be downscaled.

In one example, the upscaling area US may correspond to a plurality of pixel columns at a left edge of the display panel 20, and the downscaling area DS may correspond to a plurality of pixel columns at a right edge of the display panel 20. In this case, the image may be shifted from the upscaling area US toward the downscaling area DS. An image shift method is not limited thereto. For example, the image shifter 140 may downscale the entire image to be smaller than the screen, and may then shift the image (e.g., in a predetermined direction).

The image shifter 140 implements image shift through image scaling, so that a screen distortion, such as the screen being cut off, or such as an image not being displayed at an edge of the screen, can be eliminated.

Figure 4:
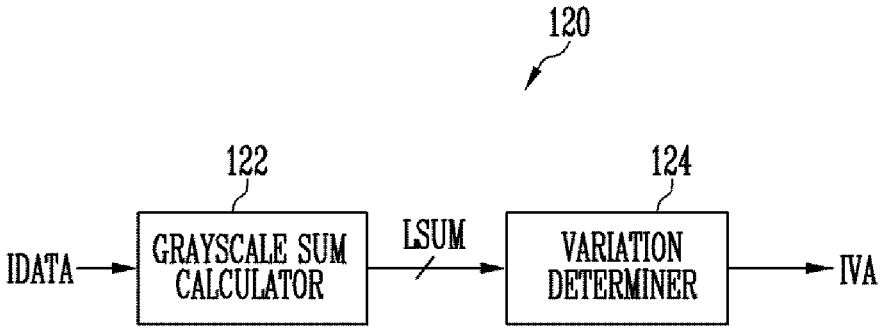
FIG. 4 is a block diagram showing an example of an image analyzer included in the afterimage compensator of FIG. 2.
Figure 5:
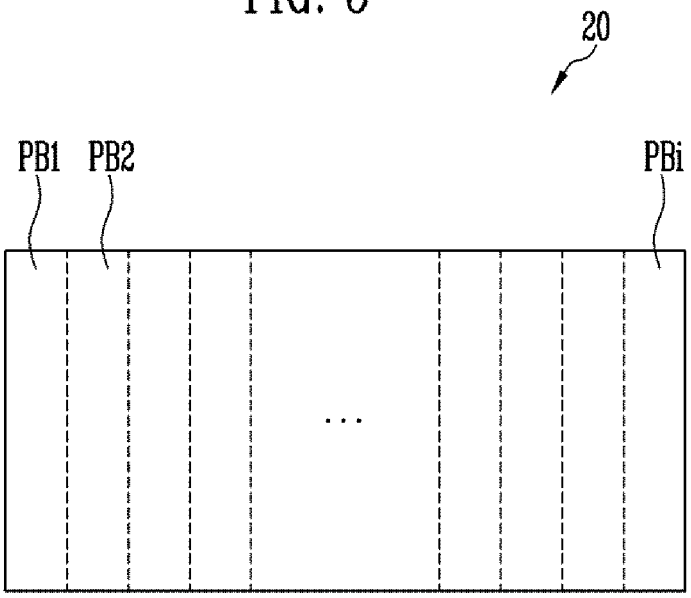
FIG. 5 is a diagram showing an example of pixel blocks for calculating grayscale sums.

FIG. 4 is a block diagram showing an example of an image analyzer included in the afterimage compensator of FIG. 2. FIG. 5 is a diagram showing an example of pixel blocks for calculating grayscale sums.

Referring to FIGS. 1, 4 and 5, the image analyzer 120 may include a grayscale sum calculator 122 and a variation determiner 124.

The grayscale sum calculator 122 may calculate a grayscale sum LSUM of each of a plurality of pixel blocks PB1 to PBi, where i is a natural number. The grayscale sum calculator 122 may calculate the grayscale sums LSUM of a frame (e.g., at a predetermined time point), and may store the calculated grayscale sum LSUM. For example, at the time of image shift, the grayscale sum calculator 122 may calculate the grayscale sums LSUM of the pixel blocks PB1 to PBi of each of two adjacent frames. Each of the pixel blocks PB1 to PBi may have p×q pixels P, where p and q are natural numbers. The pixels P included in each of the pixel blocks PB1 to PBi may be adjacent to each other.

The grayscale sum may be calculated by various methods. For example, the grayscale sum LSUM of each of the pixel blocks PB1 to PBi may be calculated by a checksum method of grayscales included in the image data IDATA. In another embodiment, the grayscale sum LSUM of each of the pixel blocks PB1 to PBi may be calculated as an average of grayscale values in each of the pixel blocks PB1 to PBi.

The variation determiner 124 may calculate differences of the grayscale sums LSUM between adjacent frames. For example, differences between first grayscale sums, which are the grayscale sums LSUM of the pixel blocks PB1 to PBi of a previous frame, and second grayscale sums, which are the grayscale sums LSUM of the pixel blocks PB1 to PBi of a current frame, may be calculated.

The first grayscale sum and the second grayscale sum may be different for a pixel block having an image variation. In addition, the larger the image variation, the greater the difference in the grayscale sum.

The variation determiner 124 may calculate an average of the differences of the grayscale sums LSUM corresponding to the pixel blocks PB1 to PBi. The average of the differences of the grayscale sums LSUM may be determined as representing, or corresponding to, the amount of image variation IVA. For example, when a grayscale of a part of the screen varies greatly, or when the entire screen varies, it may be determined that the amount of image variation IVA is large.

The configuration of the image analyzer 120, and the method of calculating the amount of image variation IVA, are not limited to the examples above. For example, the image analyzer 120 may determine the amount of image variation IVA based on a change of the image data IDATA accumulated (e.g., for a predetermined time).

Figure 6:
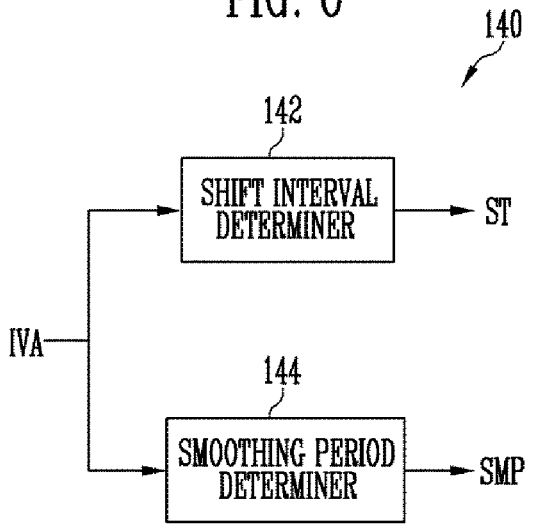
FIG. 6 is a block diagram showing an example of an image shifter included in the afterimage compensator of FIG. 2.

FIG. 6 is a block diagram showing an example of an image shifter included in the afterimage compensator of FIG. 2.

Referring to FIGS. 1, 2, and 6, the image shifter 140 may include a shift interval determiner 142 and a smoothing period determiner 144.

The shift interval determiner 142 may adjust the shift interval ST based on the amount of image variation IVA. The shift interval determiner 142 may determine the shift interval ST at the time of image shift.

In an embodiment, the shift interval determiner 142 may make the shift interval ST shorter as the amount of image variation IVA becomes larger. For example, when a current image is determined to be a still image (e.g., no image variation), the shift interval ST may be determined to be 30 seconds (about 1800 frames), and after 30 seconds, an image shift (or a shift path) may be updated. When a current image is determined to be an image having a relatively small variation (for example, a document image), the shift interval ST may be determined to be shorter than 30 seconds (for example, 24 seconds). When a current image is determined to be a moving image having a large variation (for example, a sports relay image), the shift interval ST may be further shortened.

In this manner, the shift interval ST may be adaptively adjusted according to the amount of image variation IVA by an operation of the shift interval determiner 142 at every shift time. Accordingly, the shift interval ST is shortened for a moving image, in which it is difficult to recognize the image shift, so that an image shift effect for compensating the afterimage and deterioration can be improved or maximized. In addition, as for a still image, because the shift interval ST becomes longer, the image shift is not easily recognized.

The smoothing period determiner 144 may adjust a smoothing period SMP for changing luminance of the shifted image to the target luminance in a stepwise manner based on the amount of image variation IVA. The smoothing period determiner 144 may determine the smoothing period SMP at the time of image shift.

The smoothing period determiner 144 may shorten the smoothing period SMP as the amount of image variation IVA increases. For example, when a current image is determined to be a still image, the smoothing period SMP may be determined to be about 15 seconds (about 900 frames). When a current image is determined to be an image having a relatively small variation (for example, a document image), the shift interval ST may be determined to be shorter than 15 seconds (for example, 12 seconds). When a current image is determined to correspond to a moving image having a large variation (for example, a sports broadcast), the shift interval ST may be further shortened.

During the smoothing period SMP, the luminance of the image may gradually change to the target luminance. For example, when a current luminance is about 10 nit, and when the target luminance is about 300 nit, the luminance may be increased stepwise from 10 nit to 300 nit during the smoothing period SMP. The shorter the smoothing period SMP, the faster the luminance may change to the target luminance.

The smoothing period determiner 144 may determine the smoothing period SMP corresponding to the shift interval ST. The shorter the shift interval ST, the shorter the smoothing period SMP. For example, the smoothing period SMP may be a time corresponding to about 20% to 50% of the shift interval ST.

In this manner, the smoothing period is adaptively adjusted according to the shift interval ST and/or the amount of image variation IVA, so that an image variation may be recognized as being natural.

On the other hand, the image shifter 140 may adjust the shift amount by which the image is shifted according to the amount of image variation IVA. In an embodiment, the larger the amount of image variation IVA, the larger the amount of shift. For example, in the case of a still image, the image may be shifted by one pixel in one direction of the left side, the right side, the upper side, and the lower side (e.g., may be shifted left, right, up, or down) at the time of image shift. In the case of a moving image, the image may be shifted by two pixels, or even three pixels or more, in one direction of the left side, the right side, the upper side, and the lower side at the time of image shift.

Figure 7:
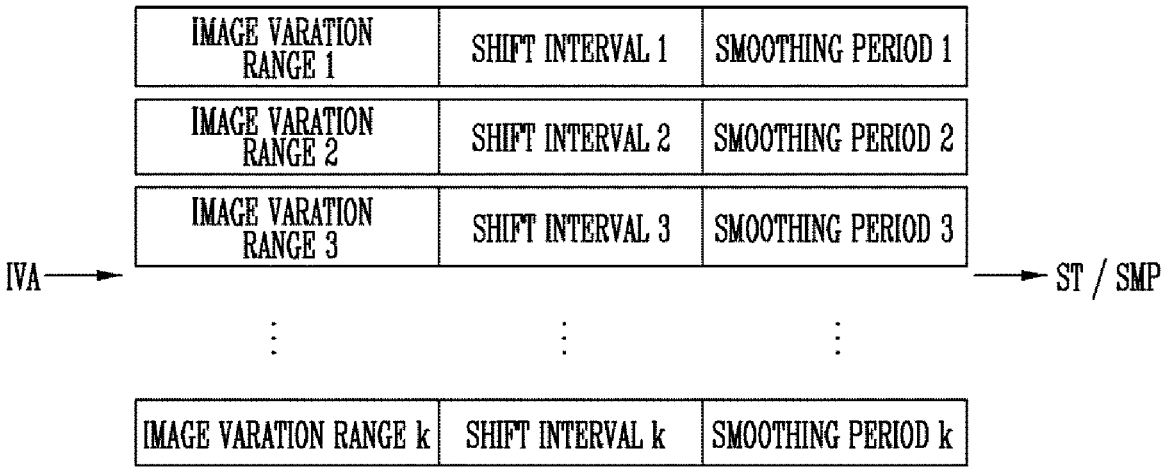
FIG. 7 is a diagram showing an example of an operation of the image shifter of FIG. 6.

FIG. 7 is a diagram showing an example of an operation of the image shifter of FIG. 6.

Referring to FIGS. 6 and 7, the image shifter 140 may determine the shift interval ST and the smoothing period SMP using a lookup table in which shift intervals and smoothing periods corresponding to ranges of the amount of image variation are set.

For example, the image shifter 140 may include k shift intervals and k smoothing periods respectively corresponding to k ranges of the amount of image variation. The shift interval ST and the smoothing period SMP may be determined corresponding to a range to which the calculated amount of image variation IVA belongs. For example, the k shift intervals may be set in a range of about 1 second to about 30 seconds, and the k smoothing periods may be set in a range of about 0.2 seconds to about 20 seconds.

The shift interval ST and the smoothing period SMP may be adaptively adjusted in accordance with the amount of image variation IVA at each time of image shift.

Figure 8:
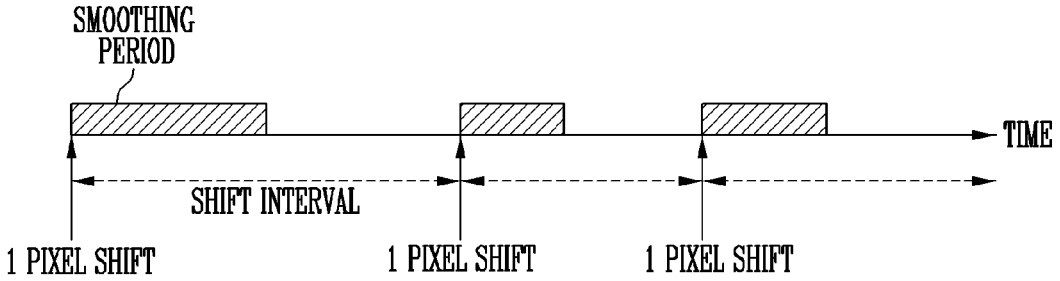
FIG. 8 is a diagram showing an example of an image shift according to an amount of image variation.

FIG. 8 is a diagram showing an example of an image shift according to an amount of image change.

Referring to FIGS. 1, 2, 7, and 8, the shift interval ST and the smoothing period SMP may be adjusted according to the amount of image variation IVA.

In an embodiment, the shift interval ST at which a next image shift is to be performed, and the smoothing period SMP corresponding to the shift interval ST, may be determined at the time of image shift. The larger the amount of image variation IVA, the shorter the shift interval ST and the smoothing period SMP.

In an embodiment, the smoothing period SMP corresponding to the shift interval ST may be a time corresponding to about 20% to 50% of the shift interval ST. For example, when the shift interval ST is about 30 seconds, the smoothing period SMP may be about 6 seconds to about 15 seconds. However, this is only an example, and the smoothing period SMP is not limited thereto. The smoothing period SMP may be reduced depending on a difference between the current luminance and the target luminance.

Figure 9:
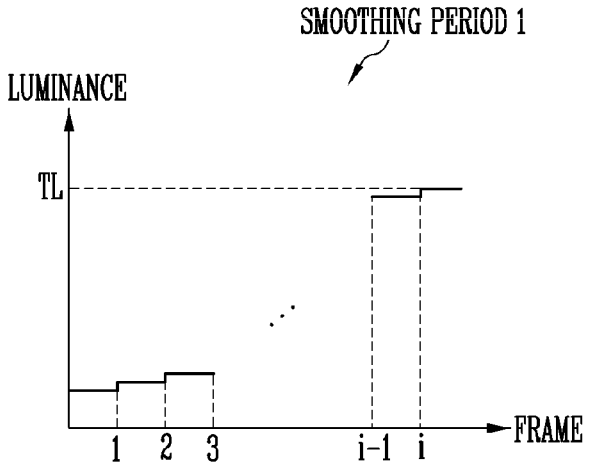
FIGS. 9 and 10 are graphs showing examples of a smoothing period according to an amount of image variation.
Figure 10:
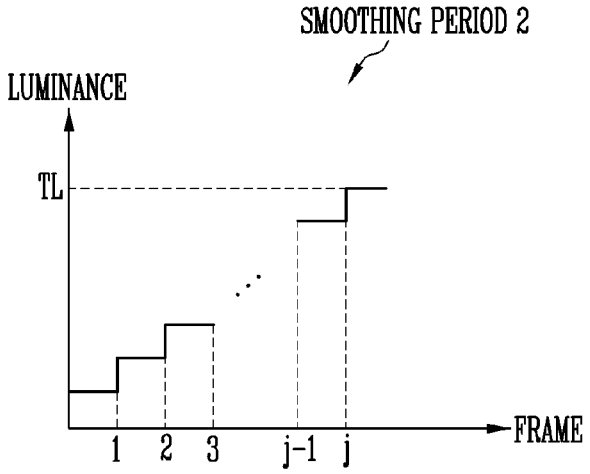

FIGS. 9 and 10 are graphs showing examples of a smoothing period according to the amount of image change.

Referring to FIGS. 7 to 10, the smoothing period SMP may be determined according to the amount of image variation IVA and/or the shift interval ST.

During the smoothing period SMP, a luminance may change stepwise toward a target luminance TL. In an embodiment, the luminance may change at a frame interval (e.g., a predetermined frame interval) during the smoothing period SMP. For example, as shown in FIGS. 9 and 10, the luminance of each frame may vary during the smoothing period SMP.

The amount of image variation IVA corresponding to the smoothing period SMP in FIG. 9 may be larger than the amount of image variation IVA corresponding to the smoothing period SMP in FIG. 10. For example, FIG. 9 shows the smoothing period SMP corresponding to a still image, and FIG. 10 shows the smoothing period SMP corresponding to a moving image. That is, the smoothing period SMP of FIG. 9 may be longer than that of FIG. 10. The smoothing period SMP in FIG. 9 is i frames, where i is a natural number, and the smoothing period SMP in FIG. 10 may be j frames, where j is a natural number that is smaller than i.

In other words, a unit of a variation amount of the luminance in the smoothing period SMP may vary depending on the amount of image variation IVA and/or the shift interval ST. The unit variation amount of the luminance in FIG. 9 may be smaller than the unit variation amount of the luminance in FIG. 10. For example, a grayscale value corresponding to the unit variation amount of the luminance may be changed by 1 in the smoothing period SMP corresponding to the still image, while the grayscale value corresponding to the unit variation amount of the luminance may be changed by 5 in the smoothing period SMP corresponding to the moving image. Therefore, the larger the amount of image variation IVA, the shorter the smoothing period SMP in which the luminance gradually changes.

Although FIGS. 9 and 10 illustrate an embodiment where the luminance increases, the luminance may gradually decrease during the smoothing period SMP in a manner that is similar to the operations of FIGS. 9 and 10 when the luminance decreases at the time of image shift.

In this manner, the smoothing period is adaptively adjusted according to the shift interval ST and/or according to the amount of image variation IVA, so that an image variation may be naturally recognized.

As described above, the afterimage compensator 100 and the display device 1 including the same, according to the embodiments of the present disclosure, may adaptively adjust the shift interval ST and the smoothing period SMP according to the amount of image variation IVA. Accordingly, the shift interval ST may be shortened for a moving image in which an image shift is difficult to recognize, and an image shift effect for compensating the afterimage and deterioration may be improved or maximized. In addition, as for a still image, because the shift interval ST and the smoothing period SMP become longer, the image shift may be difficult to recognize. Therefore, an image quality including the image shift may be improved.

Embodiments of the present disclosure may be variously applied to an electronic apparatus having a display device. For example, embodiments of the present disclosure may be applied to a TV, a smart TV, a monitor, a computer, a notebook, a digital camera, a video camcorder, a cellular phone, a smart phone, a smart pad, a car navigation system, and the like.

It will be understood by those skilled in the art that the embodiments of the present disclosure may be embodied in other specific forms without departing from the spirit or essential characteristics thereof. It is therefore to be understood that the above described embodiments are illustrative in all aspects and not restrictive. The scope of embodiments of the present disclosure is indicated by the appended claims, including functional equivalents thereof, rather than the above detailed description. And all changes or modifications derived from the meaning and scope of the claims and equivalents thereof should be interpreted as being included within the scope of the present disclosure.

What is claimed is:

1. An afterimage compensator comprising:

an image analyzer configured to determine an amount of image variation based on a change of image data; and an image shifter configured to adjust a shift interval, which is an interval between time points at which an image displayed on a display panel is spatially shifted on the display panel, according to the amount of image variation.

2. The afterimage compensator of claim 1, wherein the image shifter is configured to decrease the shift interval as the amount of image variation increases.

3. The afterimage compensator of claim 1, wherein the image shifter is configured to change luminance of a shifted image to a target luminance in a stepwise manner during a smoothing period when the image is shifted.

4. The afterimage compensator of claim 3, wherein the image shifter is configured to decrease the smoothing period as the amount of image variation increases.

5. The afterimage compensator of claim 3, wherein the image shifter is configured to decrease the smoothing period as the shift interval is decreased.

6. The afterimage compensator of claim 1, wherein the image analyzer is configured to determine the amount of image variation at a time of shifting the image.

7. The afterimage compensator of claim 1, wherein the image shifter comprises:

a shift interval determiner configured to decrease the shift interval as the amount of image variation increases; and a smoothing period determiner configured to decrease a smoothing period for which luminance of a shifted image is changed to a target luminance in a stepwise manner as the amount of image variation increases.

8. The afterimage compensator of claim 7, wherein the shift interval determiner and the smoothing period determiner are configured to determine the shift interval and the smoothing period using a lookup table in which a plurality of shift intervals and a plurality of smoothing periods respectively corresponding to a plurality of ranges of the amount of image variation.

9. The afterimage compensator of claim 1, wherein the image analyzer is configured to determine the amount of image variation from a change of grayscale between adjacent frames.

10. The afterimage compensator of claim 9, wherein the image analyzer comprises:

a grayscale sum calculator configured to calculate grayscale sums of a plurality of pixel blocks; and a variation determiner configured to calculate differences between the grayscale sums of the pixel blocks between adjacent frames, and to determine the amount of image variation using an average of the differences of the grayscale sums.

11. The afterimage compensator of claim 1, wherein the image analyzer is configured to determine the amount of image variation from a ratio of a number of pixels in which the image data is changed to a total number of the pixels.

12. A display device comprising:

a display panel comprising a plurality of pixels;

an afterimage compensator configured to correct an image data so that an image displayed on the display panel is spatially shifted on the display panel, and configured to adjust a shift interval of the image based on an amount of image variation; and a data driver configured to provide a data signal corresponding to a corrected image data to the display panel.

13. The display device of claim 12, wherein the afterimage compensator comprises:

an image analyzer configured to determine the amount of image variation based on a change of the image data between frames; and an image shifter configured to adjust a shift interval, which is an interval between time points at which an image is shifted, according to the amount of image variation, and configured to adjust a smoothing period for which luminance of a shifted image is changed to a target luminance in a stepwise manner.

14. The display device of claim 13, wherein the image shifter is configured to decrease the shift interval as the amount of image variation increases.

15. The display device of claim 13, wherein the image shifter is configured to decrease the smoothing period as the shift interval decreases.

16. The display device of claim 13, wherein the image shifter is configured to decrease the smoothing period as the amount of image variation increases.

17. The display device of claim 13, wherein the image analyzer is configured to determine the amount of image variation at a time of shifting the image.

* * * * *